United States Patent [19]

Schade

[11] 4,353,006

[45] Oct. 5, 1982

[54] CRT WITH MEANS FOR SUPPRESSING ARCING THEREIN

[75] Inventor: Horst E. P. Schade, Blawenburg, N.J.

[73] Assignee: RCA Corporation, New York, N.Y.

[21] Appl. No.: 153,970

[22] Filed: May 28, 1980

[51] Int. Cl.[3] ..... H01J 29/02; H01J 29/82

[52] U.S. Cl. ..... 313/457; 313/417

[58] Field of Search ..... 313/457, 417, 479

[56] References Cited

U.S. PATENT DOCUMENTS

| | | | |
|---|---|---|---|
| 3,355,617 | 11/1967 | Schwartz et al. . | |
| 3,758,802 | 9/1973 | Kubo et al. | 313/479 |
| 3,979,632 | 9/1976 | Gunning et al. | 313/479 |
| 4,288,719 | 9/1981 | Hernqvist | 313/457 |

OTHER PUBLICATIONS

"The Effect of Chromium Oxide Coatings on Surface Flashover of Alumina Spacers in Vacuum", by T. S. Sudarshan et al., IEEE Transactions on Electrical Insulation, vol. E1-11, pp. 32-35, Mar. 1976.

*Primary Examiner*—Palmer C. Demeo

*Attorney, Agent, or Firm*—E. M. Whitacre; D. H. Irlbeck; L. Greenspan

[57] ABSTRACT

A CRT comprising an evacuated envelope having an electrically-insulating neck and a beaded electron-gun mount assembly in the neck. The beads of the assembly are closely spaced from the inner surface of the neck. At least a portion of the surface of each of the beads opposite the neck carries a patch of chromium oxide.

7 Claims, 4 Drawing Figures

CRT WITH MEANS FOR SUPPRESSING ARCING THEREIN

BACKGROUND OF THE INVENTION

This invention relates to a novel CRT (cathode-ray tube) having means for suppressing arcing therein; and particularly for suppressing flashovers in the neck of a CRT having a beaded mounted assembly.

A color television picture tube is a CRT which comprises an evacuated glass envelope including a viewing window which carries a luminescent viewing screen, and a glass neck which houses an electron-gun mount assembly, for producing one or more electron beams for selectively scanning the viewing screen. Each gun comprising the mount assembly comprises a cathode and a plurality of electrodes supported as a unit in spaced tandem relation from at least two elongated, axially-oriented insulating support rods, which are usually of glass and are commonly referred to as beads. The beads have extended surfaces closely spaced from and facing the inner surface of the glass neck. The beads usually extend from the region close to the stem, where the ambient electric fields are small, to the region close to the electrode to which the highest operating potential is applied, where the ambient electric fields are high during the operation of the tube. The spaces between the beads and the neck surfaces are referred to as bead channels. Leakage currents may travel longitudinally in the bead channels from the stem region to the region of the highest-potential electrode. These leakage currents are associated with blue glow in the neck glass, with charging of the neck and/or bead surfaces and with arcing or flashover in the neck. The driving field for these leakage currents is the longitudinal component of the electric field in each bead channel.

Several expedients have been suggested for blocking or reducing these leakage currents. Coatings on the neck glass are partially effective to prevent arcing but are burned through when arcing does occur. A metal wire or ribbon in the channel (partially or completely around the mount assembly) is also only partially effective to reduce arcing because they are often bypassed due to their limited longitudinal extent, because the limited space between the bead and the neck may result in shorting problems, and because there is frequently field emission from these metal structures.

SUMMARY OF THE INVENTION

The novel CRT is similar to prior CRTs in that it comprises an evacuated envelope including a neck of glass or other insulating material. An electron-gun mount assembly, including a plurality of electrodes mounted on at least two insulating support rods or beads of glass or other electrically-insulating material, is housed in the neck with the beads closely spaced from the inside surface of the neck. Unlike prior CRTs, each bead has an area or patch of chromium oxide, which is believed to be $Cr_2O_3$, on the surface facing the neck. The chromium-oxide patches may be electrically floating, which is preferred, or may be connected to an electrode of the mount assembly or to a fixed voltage.

Each chromium-oxide patch has the effect of reducting the longitudinal flow of leakage current in the bead channel, at least to the point that arcing is suppressed substantially. Each chromium-oxide patch, in any of its forms, requires only a minimum of space in which to exist, and is easily prepared by steps and with materials that are compatible with present beading technology.

DETAILED DESCRIPTION OF THE PREFERRED EMBODIMENT

Figure 2:
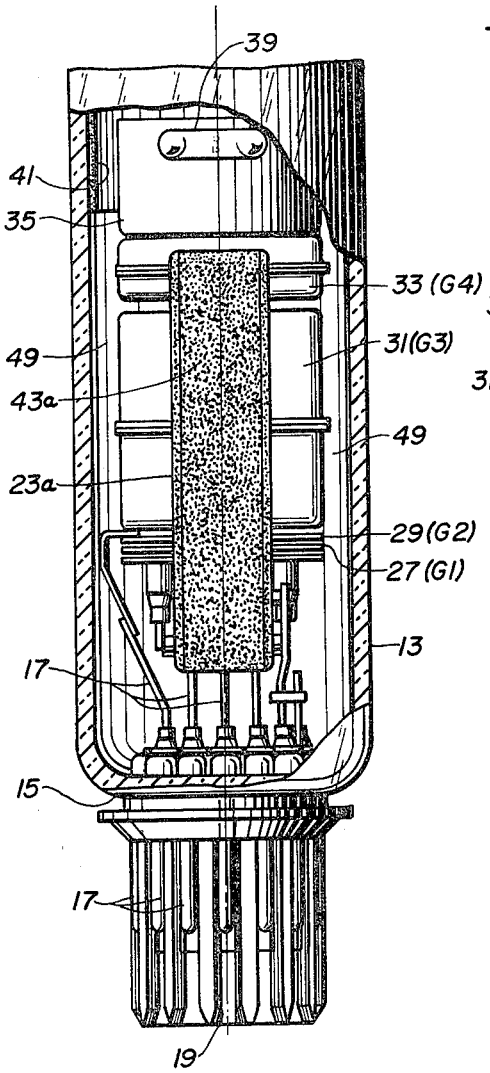
FIG. 2 is a broken-away, side, elevational view along section line 2—2 through the neck of the CRT shown in FIG. 1.
Figure 1:
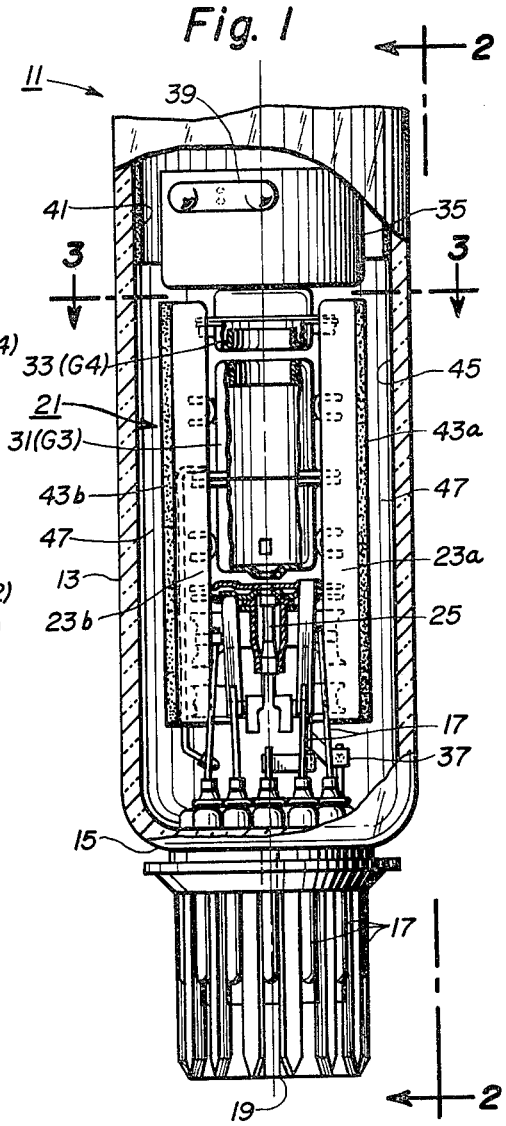
FIG. 1 is a broken-away, front, elevational view of the neck of a preferred CRT according to the invention.
Figure 3:
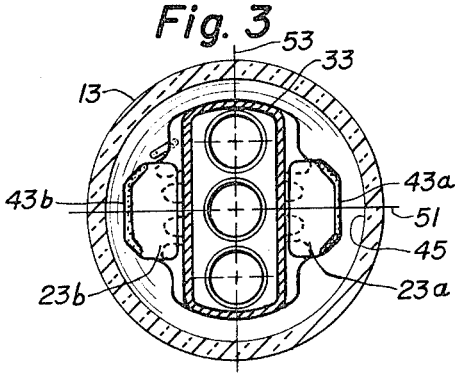
FIG. 3 is a sectional view along section line 3—3 through the neck of the CRT shown in FIG. 1.

FIGS. 1, 2 and 3 show structural details of the neck of a particular shadow-mask-type color television picture tube. The structure of this CRT, which is a rectangular 25 V size tube with 110° deflection, is conventional except for the electron-gun mount assembly. The structural details thereof are similar to those described in U.S. application Ser. No. 078,134 filed Sept. 24, 1979 by R. H. Hughes et al. The CRT includes an evacuated glass envelope 11 comprising a rectangular faceplate panel (not shown) sealed to a funnel having a neck 13 integrally attached thereto. A glass stem 15 having a plurality of leads or pins 17 therethrough is sealed to and closes the neck 13 at the end thereof. A base 19 is attached to the pins 17 outside the envelope 11. The panel (not shown) includes a viewing window which carries on its inner surface a luminescent viewing screen comprising phosphor lines extending in the direction of the minor axis thereof, which is the vertical direction under normal viewing conditions.

An in-line beaded bipotential electron-gun mount assembly 21, centrally mounted within the neck 13, is designed to generate and project three electron beams along coplanar convergent paths to the viewing screen. The amount assembly comprises two glass support rods or beads **23*a* and 23*b* from which the various electrodes are supported to form a coherent unit in a manner commonly used in the art. These electrodes include three substantially equally transversely spaced coplanar cathodes 25 (one for producing each beam) a control-grid electrode (also referred to as $G_1$) 27, a screen grid electrode (also referred to as $G_2$) 29, a first accelerating and focusing electrode (also referred to as $G_3$) 31, a second accelerating and focusing electrode (also referred to as $G_4$) 33, and a shield cup 35, longitudinally spaced in that order along the beads 23*a* and 23*b*. The various electrodes of the mount assembly 21 are electrically connected to the pins 17 either directly or through metal ribbons 37. The mount assembly 21 is held in a predetermined position in the neck 13 on the pins 17 and with snubbers 39 which press on and make contact with an electrically-conducting internal coating 41 on the inside surface of the neck 13. The internal coating 41** extends over the inside surface of the funnel and connects to an anode button (not shown).

Each of the beads **23*a* and 23*b* is about 10 mm (millimeters) wide by 45 mm long and carries an area or patch 43*a* and 43*b* respectively of chromium oxide on at least a portion of its surface facing and spaced from the inside surface 45 of the neck 13. In this example, each patch 43*a* and 43*b* is prepared in the following manner. A solution of chromium trioxide $CrO_3$ in water in a 1:1 ratio by weight is prepared. A small quantity of this solution is reacted with methanol. The reaction product is brushed or otherwise applied on the surface area of interest prior to the beading operation and then dried, thereby forming the patch. Then, during the beading operation, when the bead is heated, the patch turns greenish, into what is believed $Cr_2O_3$. In this example, each patch 43***a* and 43*b* is substantially rectangular and about 45 mm long by about 10 mm wide, which is the full length and width of the bead. Each patch is floating electrically. Each patch has an estimated resistance of about $10^{10}$ ohms per square.

The tube may be operated in its normal way by applying operating voltages to the pins 17 and to the internal coating 41 through the anode button; which, for example, are typically less than 100 volts on $G_1$, about 600 volts on $G_2$, about 5,000 volts on $G_3$ and about 30,000 volts on $G_4$. Because of the beaded structure described, the spaces between the opposed surfaces of the beads and the neck, which are referred to herein as bead channels 47 (FIG. 1) behave differently than the spaces between the opposed surfaces of the neck and the other parts of the mount assembly, which are referred to herein as gun channels 49 (FIG. 2). When the tube is operating and the patches 43*a* and 43*b* are absent, arcing (flashover), when it occurs, occurs in the bead channels 47. However, with the patches 43*a* and 43*b* present as shown in FIGS. 1, 2 and 3, arcing in the bead channels 47 is substantially suppressed.

Several different types of breakdown phenomena have been observed with mount assemblies of the type described above. From the point of view of the required preventive measures, these phenomena are conveniently classified as (a) breakdowns occurring directly from one metallic electrode to another (primarily between $G_3$ and $G_4$, and to a lesser extent between $G_2$ and $G_3$) and (b) breakdowns involving insulators (the neck glass and/or the glass beads) as intermediaries.

A direct electrode-to-electrode breakdown is usually due to the presence of one or more of microprotrusions or dust on an electrode or due to the passage of particulate matter from one electrode to another. Sharp points or edges and weld splash on $G_3$ can cause field emission leading to breakdown events. The main preventive measure here is high-voltage processing, mainly spot knocking. Intense discharges during this electrical processing cause melting, vaporization or blunting of sharp points. The high voltage also seeks out dust and other particles, and these are disintegrated or transported to less stressed regions of the gun. Ordinary spot knocking may leave craters with sharp edges on polished surfaces, particularly in areas subjected to the fringe fields. RF spot knocking appears to sweep away crater material leaving a much smoother surface.

A breakdown involving the neck glass or an insulator is referred to herein as a flashover. It requires charging of the surface of the glass or insulator and is usually preceded by easily-visible blue glow of the neck glass. Flashovers orignating in the regions of the top and flange portions of $G_3$ can easily be prevented by effective RF spot knocking. A more severe form of flashover involves field emission in the stem region of the gun where spot knocking is less effective. The usual series of events leading to a flashover is believed to proceed according to the following steps: (1) Due to the small but finite conductivity of the glass, the applied voltage to $G_4$ (about 30 kv) makes itself felt opposite the lower portion of the gun. (2) If points or protrusions are present in this region, field-emitted electrons from these points strike the surface of the glass and/or insulator. (3) Secondary electron emission occurs leading to electron avalanches, primarily along the surfaces defining the relatively-isolated bead channels formed between the beads and the neck glass. Radial components of the electric fields that are present force electrons towards the centerline of the CRT; that is, towards the surfaces of the beads. These avalanches terminate opposite $G_4$. The avalanches can be quite stable carrying leakage currents of up to a few microamperes. (4) The electrons flowing in the avalanches impacting on the surfaces defining the bead channels can cause desorption of adsorbed gas atoms from these surfaces. This gas can be ionized by the electrons; and the ions, under the influence of electric fields that are present, can travel to the field emitter, causing more emission (ion feedback). Thus, a runaway condition can occur, leading to a flashover, more likely closer to the bead than the neck. With the occurrence of the flashover, the glass is discharged, and the electron avalanche and ion generation are discontinued, until the whole process, steps (1) to (4), may be repeated. However, after each flashover, the field emitters present may be more blunted and also the surfaces may be more outgassed; thus, the tube can arc itself to stability, as is frequently observed. Arcing-to-stability is, however, a time-consuming process since each charging-flashover cycle may last for periods of minutes up to tens of minutes.

In principle, any measure that impedes any of the events in the charging-flashover cycle may prevent arcing. The most effective preventing measures have been found to be obstacles in the path of the electron avalanches. These obstacles (generally referred to as suppressors) may consist of a metal wire or ribbon tied to $G_3$ and traversing the channel between the bead and the neck glass. Other obstacles found effective are conducting coatings on the neck glass or on the beads along this channel. Avalanches along the glass may by themselves be harmless. But, flashovers, especially when they occur frequently, may burn through such coating producing undesirable debris. Another obstacle found effective is a roughened insulative oxide coating, such as chromic oxide, on the internal surface of the neck, in order to break up the deposition of metallic sublimation and thus deter the buildup of charges on the neck. However, due to the small but finite conductivity of the glass, the applied voltage to $G_4$ makes itself still felt in the region of that neck coating, and thus flashovers, as described above by steps (1) to (4), may still develop.

Figure 4:
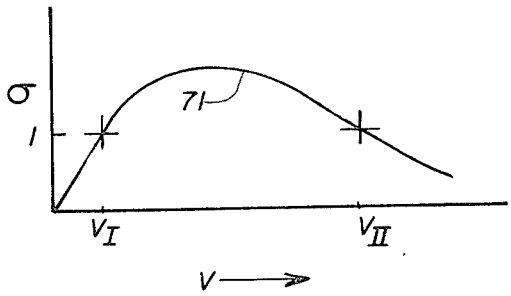
FIG. 4 is a curve showing some conditions for secondary emission from a glass surface.

The mechanics of establishing electron avalanches has been extensively discussed in the literature. Two electron-emission processes, namely field emission and secondary electron emission, are important. Field emission is a cold-emission process requiring very high fields ($\sim 10^7$ volts/cm) at the emitter. Secondary electron emission is encountered when any object (metal or insulator) is bombarded with primary electrons. The yield $\sigma$ of secondary emission is given by $$\sigma = \frac{\text{No. of secondary electrons}}{\text{No. of primary electrons}}$$

which is a function of the primary electron impact energy V. This relation between $\sigma$ and V is usually of the form shown in the curve 71 in FIG. 4. Of particular significance are the values of the impact energies $V_I$ and $V_{II}$ for which $\sigma = 1$. Important also is the average initial energy $\overline{V}_o$ at which the secondary electrons come off the emitters. Typically for glass, $V_I=30$ volts, $V_{II}=2500$ volts, and $\overline{V}_o=5$ volts. The case when the secondary emitter is an insulator (for instance, the bead glass) requires special consideration since equal numbers of electrons must arrive and leave the emitter in order to avoid charging. Except when $V=V_I$ or $V_{II}$, the insulator surface always charges up to some potential to satisfy this requirement.

The presence of the chromium-oxide patch on each bead employed in the novel CRT as in FIGS. 1, 2 and 3 is believed to reduce the secondary emission ratio on the surfaces where avalanches are most likely to occur. This reduces the regenerative accumulation of charges in the bead channel. Thereby, the presence of the chromium-oxide patch on the bead surface makes the bead-plane unfavorable for avalanches.

In view of the foregoing considerations, each bead patch may be of any size and/or shape, and the same or different sizes and/or shapes may be used on different beads in the same tube. For greatest flashover suppression, the patch should be as wide as the bead and as long as possible without providing sources of cold or hot emission. The patches are preferably not connected; that is, they are electrically floating, but they may be connected to a fixed potential such as the $G_3$ electrode, or to ground potential.

The patches can be formed by a surface treatment to the beads or by direct coating on the surfaces of the beads. It is preferred that the patches are made with a coating prepared by the method described in the example in which chromium oxide is deposited from an aqueous medium. Chromium oxide can also be obtained by a deposition of chromium metal and concurrent or subsequent oxidation. Also, the areas can be produced by painting or spraying a layer of a chromium compound on the surfaces of the beads and then heating the beads to cure the layer. The patches may be produced before or after the mount assembly is assembled, and before or after the mount assembly is sealed into the neck of the CRT, and before or after the envelope is exhausted and sealed.

In one embodiment, $CrO_3$ is dissolved in water in a 1:1 ratio by weight. Small quantities of this solution are reacted with methanol, whereby $CrO_3$ is reduced to $Cr_2O_3$. The solution of $Cr_2O_3$ in methanol is brushed or painted onto the bead surface and then dried, whereby the patch is formed. Then during the beading operation, when the bead is heated, the patch turns into greenish $Cr_2O_3$.

In another embodiment, a patch of chromium metal is coated onto the bead surface, either by vacuum evaporation, or by using a resinate process. The chromium metal layer is then oxidized at a sufficiently high temperature to form greenish $Cr_2O_3$. The coated beads are then used in the known beading processes for assembling a beaded mount assembly.

In still another embodiment, a thin layer of $Cr_2O_3$ may be directly deposited on the surface of a glass bead by sputtering from a chromium metal cathode in an ambient containing oxygen, or by evaporation of chromium metal in a poor vacuum (about $10^{-3}$ Torr) containing oxygen.

In still another embodiment, an organosol of $Cr_2O_3$ is brushed, sprayed, or painted onto the bead surface and then cured in order to drive off the liquid. The patches may thus be produced before or after the beading operation.

A series of dummy tubes with guns like those of FIGS. 1 to 3 with chromium-oxide-coated beads, along with a series of control tubes, has been prepared and tested with the following results: (1) During the high-voltage processing (without RF spot knocking) less arcing activity was observed for the tubes with coated beads. (2) In one test, after high-voltage processing, without RF spot knocking, the average 24-hour arc count was about 8 for tubes with chromium-oxide-coated beads (13 tubes), and was about 100 for tubes with uncoated beads (4 tubes). (3) In another test, after high-voltage processing, including RF spot knocking, the average 24-hour arc count was about 1 for tubes with chromium-oxide-coated beads (5 tubes), and about 25 for tubes with uncoated beads (4 tubes).

I claim:

1. A cathode-ray tube comprising an evacuated envelope including an electrically-insulating neck, and an electron-gun mount assembly in said neck, said mount assembly comprising a plurality of electrodes mounted on at least two electrically-insulating support rods, said assembly being closely spaced from the inner surface of said neck, at least a portion of the surface of each of said support rods opposite said neck carrying a patch coating of chromium oxide.

2. The cathode-ray tube defined in claim 1 wherein each of said patches consists essentially of chromic oxide $Cr_2O_3$.

3. The cathode-ray tube defined in claim 1 wherein each of said patches is prepared by a process which consists essentially of applying to said surface a layer of a liquid medium containing a chromium compound, drying said layer to produce said patch, and then heating said patch in air until said patch turns greenish.

4. The cathode-ray tube defined in claim 3 in which said liquid medium is prepared by dissolving chromium trioxide in water to produce a solution, and reacting a quantity of said solution with methanol to produce said liquid medium.

5. The cathode-ray tube defined in claim 1 wherein each of said patches is prepared by a process which consists essentially of depositing chromium metal on said surface and then oxidizing said deposited metal to chromium oxide.

6. The cathode-ray tube defined in claim 1 wherein each of said patches is prepared by depositing chromium oxide directly on said surface.

7. The cathode-ray tube defined in claim 1 wherein each of said patches is prepared by applying to said surface a thin layer of an organosol of chromium oxide and then curing said layer.

* * * * *